US007083070B2

(12) United States Patent
McGuyer

(10) Patent No.: US 7,083,070 B2
(45) Date of Patent: Aug. 1, 2006

(54) CONDIMENT DISPENSING CONTAINER AND CAROUSEL

(75) Inventor: Carter W. McGuyer, Muscle Shoals, AL (US)

(73) Assignee: Robbins Industries, Inc., Florence, AL (US)

( * ) Notice: Subject to any disclaimer, the term of this patent is extended or adjusted under 35 U.S.C. 154(b) by 176 days.

(21) Appl. No.: 10/699,234

(22) Filed: Oct. 31, 2003

(65) Prior Publication Data

US 2004/0251283 A1 Dec. 16, 2004

Related U.S. Application Data

(60) Provisional application No. 60/467,815, filed on May 2, 2003.

(51) Int. Cl.
*B67D 5/60* (2006.01)

(52) U.S. Cl. ..... 222/144; 222/180; 222/186; 222/143; 211/77; 221/119

(58) Field of Classification Search ..... 211/77, 211/78, 163, 144; 222/142–144, 348, 168.5, 222/180, 186, 609; 221/119
See application file for complete search history.

(56) References Cited

U.S. PATENT DOCUMENTS 4,700,850 A * 10/1987 Morgan et al. ..... 211/131.1
5,490,615 A * 2/1996 Robbins et al. ..... 222/153.13
D392,852 S 3/1998 Weterrings et al.
D402,849 S 12/1998 Weterrings et al.
D403,923 S 1/1999 Weterrings et al.
D407,610 S 4/1999 Weterrings et al.
5,931,356 A * 8/1999 Lillelund et al. ..... 222/485
6,182,839 B1 2/2001 Robbins et al.
6,283,339 B1 * 9/2001 Morrow ..... 222/452
6,308,838 B1 * 10/2001 Endean ..... 211/37
D464,533 S 10/2002 McGuyer
6,585,119 B1 * 7/2003 Palder ..... 211/49.1
6,591,993 B1 * 7/2003 Humphrey ..... 211/85.14

FOREIGN PATENT DOCUMENTS

GB 3002855 4/2002

OTHER PUBLICATIONS

Handy Spice Instructions Brochure.

* cited by examiner

*Primary Examiner*—Michael Mar
*Assistant Examiner*—Melvin A. Cartagena
(74) *Attorney, Agent, or Firm*—Kramer Levin Naftalis & Frankel LLP; Gregor N. Neff

(57) ABSTRACT

Substantially cylindrical condiment containers with extendable and retractable pouring spouts are provided. A dispensing mechanism in each container can be actuated by simply rotating a portion of the body of the container, without the need for separate knobs or levers. The central projection of the carousel is made of a plurality of spaced vertical struts or rods to reduce weight and cost. The central projection is releasably attached to the base with a locking mechanism, and there is a like locking mechanism at the top. The central projection of one carousel can be locked into the locking mechanism at the top of another carousel to attach one carousel on top of another.

9 Claims, 6 Drawing Sheets

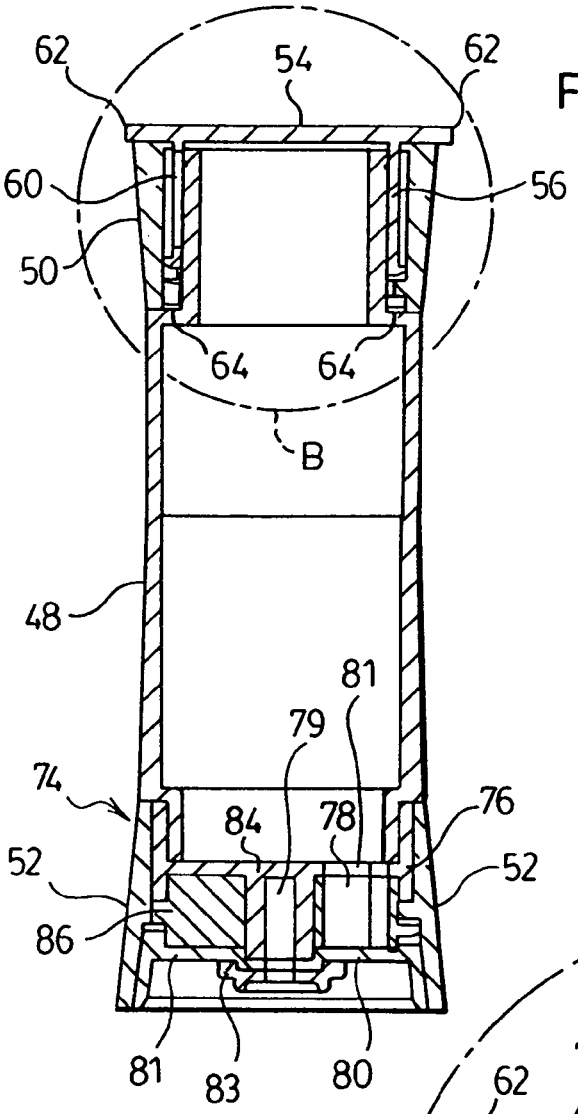
FIG. 5
FIG. 6
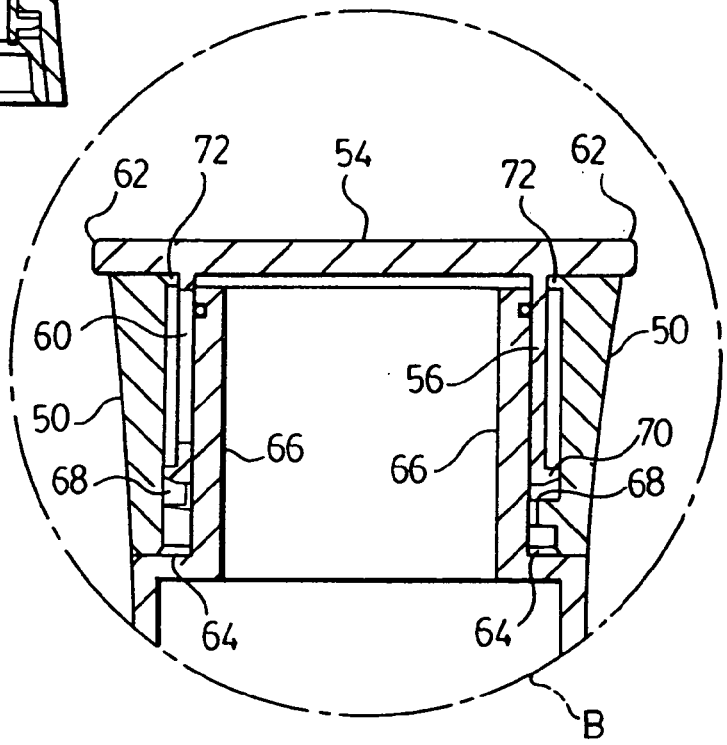

CONDIMENT DISPENSING CONTAINER AND CAROUSEL

This invention relates to dispensing containers, and particularly to condiment dispensing containers, and to carousels for storing and organizing such containers. Priority is claimed from U.S. Provisional Patent Application Ser. No. 60/467,815, filed May 2, 2003.

Condiment dispenser carousels such as those sold by Robbins Industries, Inc., the assignee of this patent application, have become very popular. Such carousels store different spices in wedge-shaped dispensing containers which can be used to dispense automatically pre-measured quantities through the bottom, or unmeasured quantities through openings in the top.

It is an object of the present invention to provide a device of the same type which uses dispensing containers of a shape and size which makes them especially easy to handle.

It is another object to provide such dispensing containers are relatively simple in construction and easy to use.

It is another object of the invention to provide a carousel device which is relatively sturdy and yet inexpensive to manufacture.

It is a further object of the invention to provide a carousel device which easily can be stacked on top of another carousel and locked in place without the use of tools or extra components.

In accordance with the present invention, the foregoing objects are satisfied by the provision of a dispensing container and carousel in which the container has an extendable and retractable dispensing spout.

The container can have a substantially cylindrical shape, instead of the more usual wedge shape, and is relatively easy to handle.

The container has a pre-measured dispensing mechanism which can be rotated simply by turning a portion of the body of the container. No additional levers or knobs are needed.

The carousel construction is reduced in cost by the provision of a plurality of upstanding struts or rods which are used to form a central projection for rotatably supporting the container.

The carousel unit is made easily stackable with one or more other carousel units. This is done by using a first locking mechanism to releasably attach the central projection of the carousel to the base member, and providing a second locking mechanism at the top of the central projection. The base member permits the units to be stacked atop one another without the use of tools or extra parts.

The foregoing and other objects and advantages of the invention will be set forth in or apparent from the following decription and drawings.

IN THE DRAWINGS

FIG. 5 is a cross-sectional view taken along line 5—5 of FIG. 4, but with the spout structure retracted;

FIG. 6 is an enlarged representation of the portion of the structure of FIG. 5 encircled by the line B.

GENERAL DESCRIPTION

Figure 1:
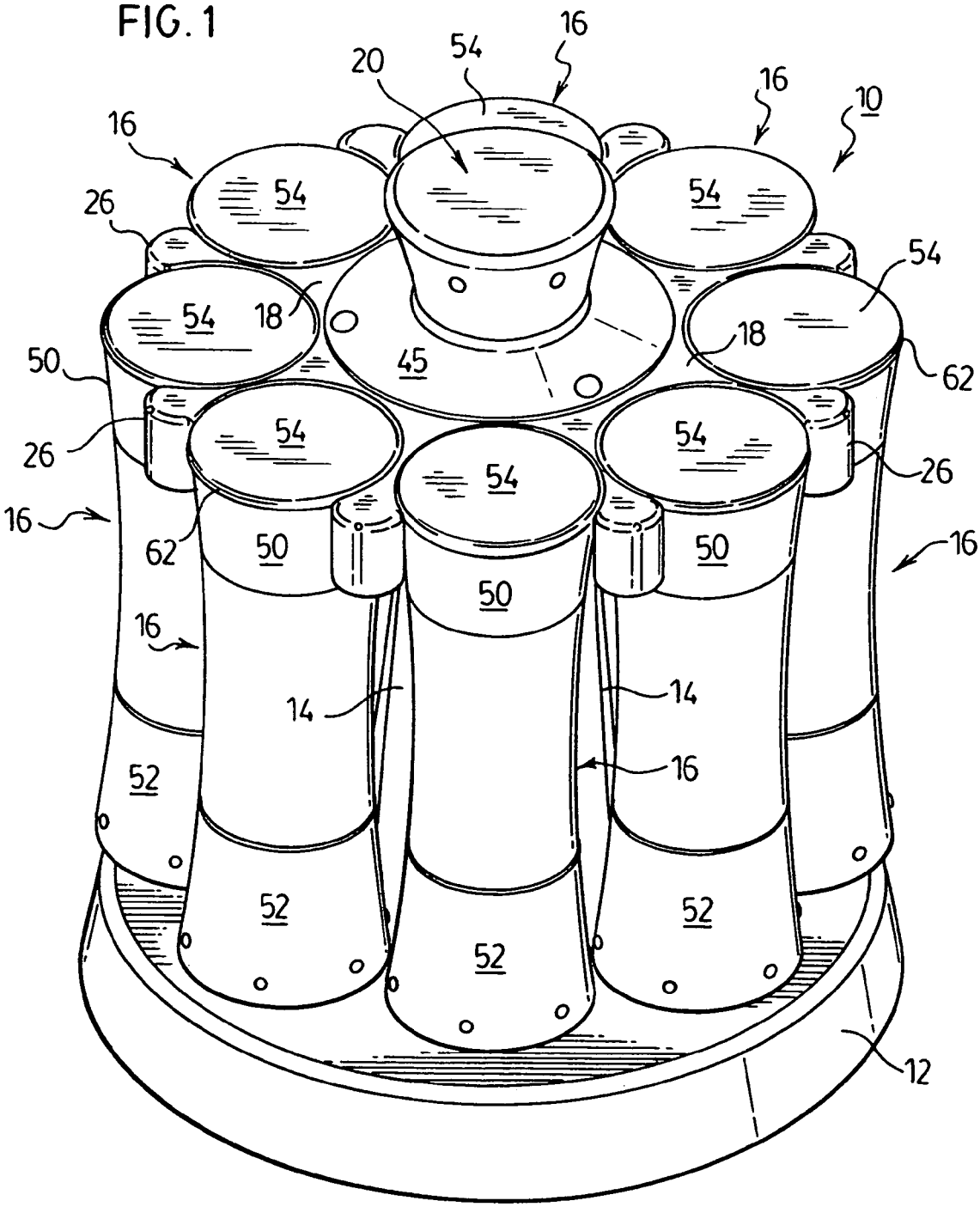
FIG. 1 is a perspective view of the preferred embodiment of the present invention.

FIG. 1 shows the condiment dispensing carousel 10 of the present invention. The carousel includes a base member 12, and a plurality of rod-shaped vertical struts 14 arranged in a circular pattern to form a central vertical projection from the base member 12. Several dispensing containers 16 are supported on a holding structure 18 which is rotatably mounted on the central projection so that the containers can be rotated to facilitate location of a desired container.

A handle structure 20 is secured to the holding structure 18 to provide a means for easily lifting the carousel.

Figure 2:
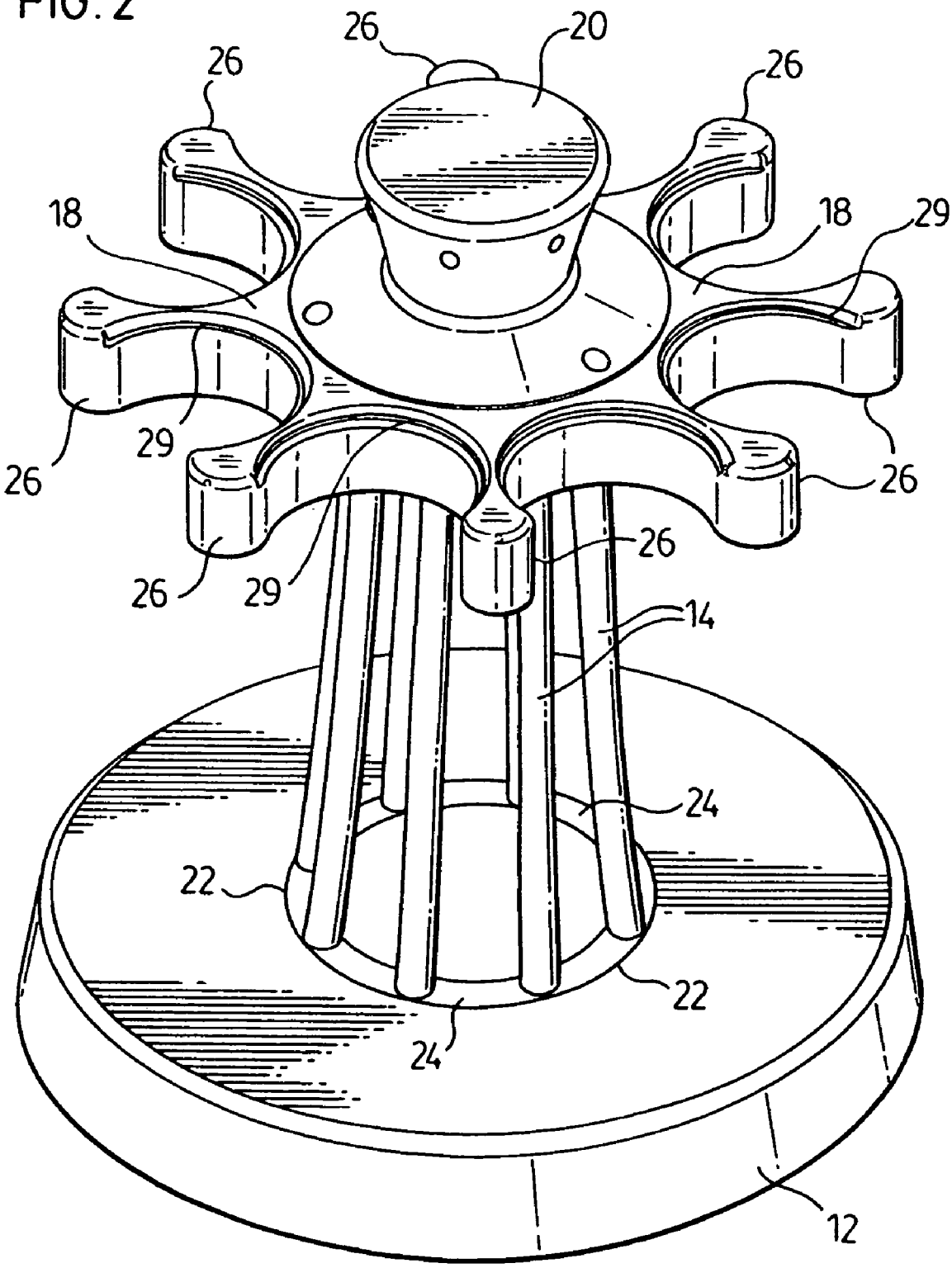
FIG. 2 is a perspective view of the structure of FIG. 1 with the dispensing containers removed.

Referring now to FIG. 2, the carousel structure includes a ring 24 securing the lower ends of the struts 14 together. The ring is fastened to the base 12 by means of a releasable locking structure including a circular groove 22 in the base member 12 with locking tab receptacles 27 (FIG. 3), and locking tabs 25 on the ring 24 which fit into the receptacles when the ring 24 is inserted into the groove 22 and twisted. This locks the central projection to the base.

Figure 3:
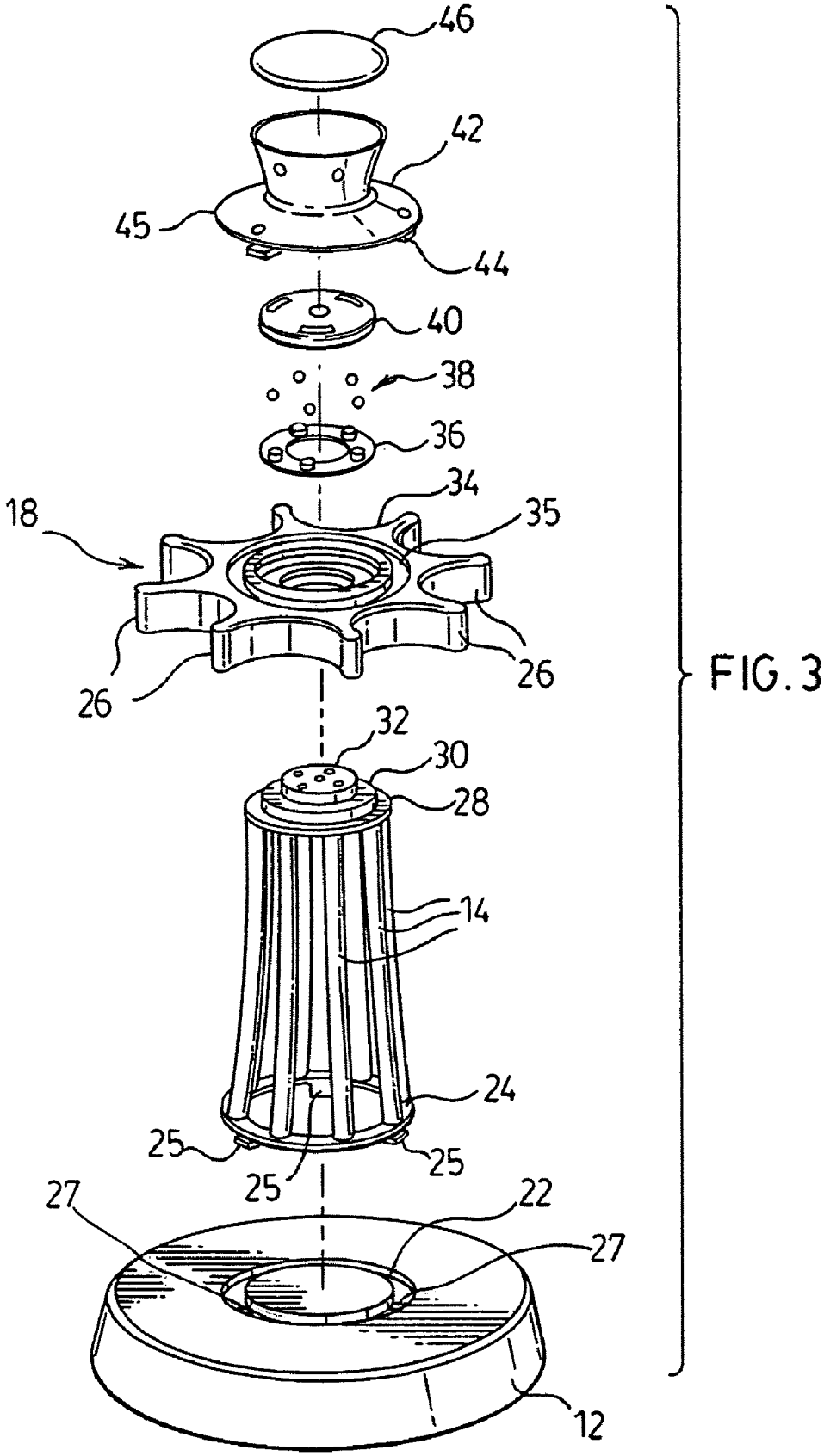
FIG. 3 is an exploded view of the structure of FIG. 2.

Still referring to FIG. 3, another ring 28 attaches the upper ends of the struts 14 together and forms concentric bearing and mounting surfaces 30 and 32.

As it is shown in FIG. 2, the dispensing container holder 18 has a plurality of radial arms 26 forming approximately semi-circular recesses with an indented groove 29 around the upper edge of each recess.

Referring again to FIG. 3, the holder 18 includes a central hub 34, a ballbearing race 36 and ballbearings 38, and a retainer plate 40 which is used to hold the ballbearings, the hub 34 and the structure at the top of the struts 14 together so that the holder 18 can rotate smoothly on the ball bearings to easily rotate the dispensing containers into position.

In the upper surface of the holder 18 is a groove 35 of the same shape as the groove 22 in the base and having lock tab receptacle openings like the openings 27 in the groove 22.

The handle structure includes a base 42 with a flange 45 and lock tabs 44 which fit into the groove 34 and can be rotated to lock the handle in place. A cap 46 is fastened to the upper surface of the handle structure.

When the parts are assembled together, the container holder 18 rotates smoothly on the central projection.

DISPENSING CONTAINER

Figure 4:
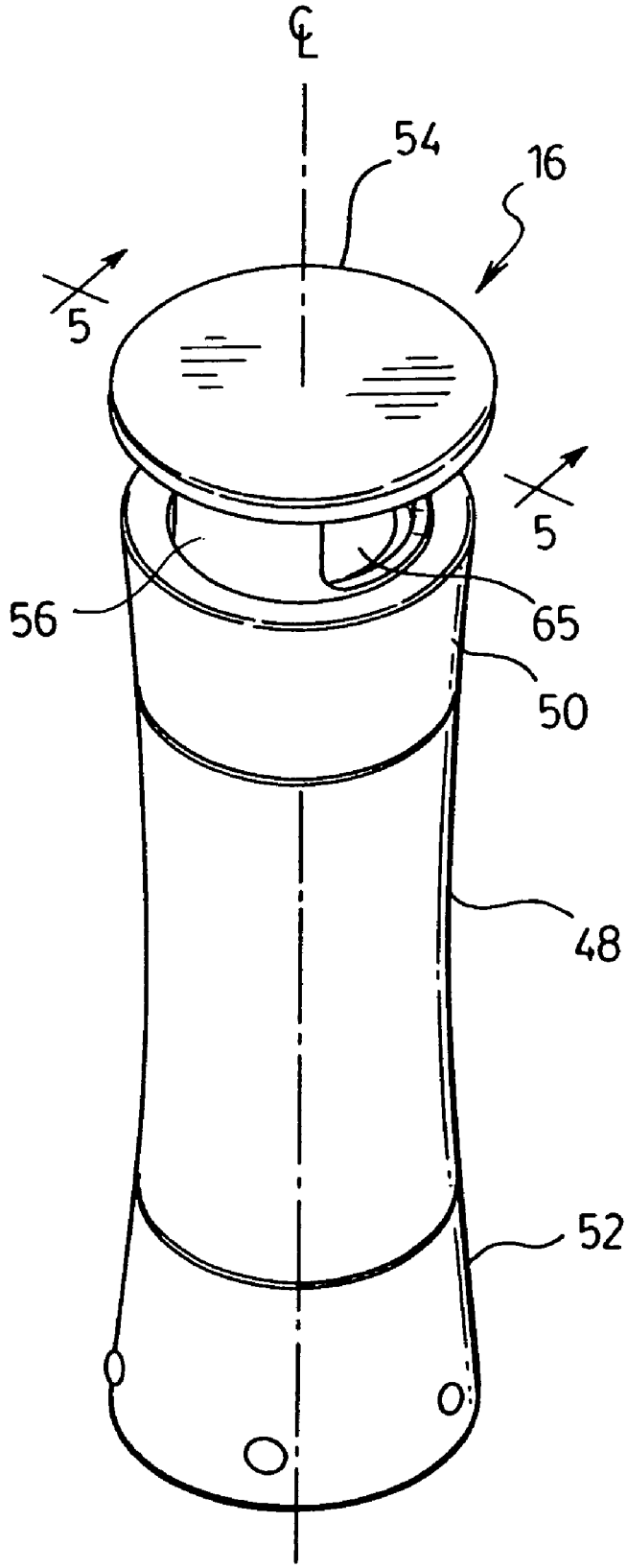
FIG. 4 is a perspective view of one of the containers shown in FIG. 1, with its retractable spout structure raised for use.
Figure 7:
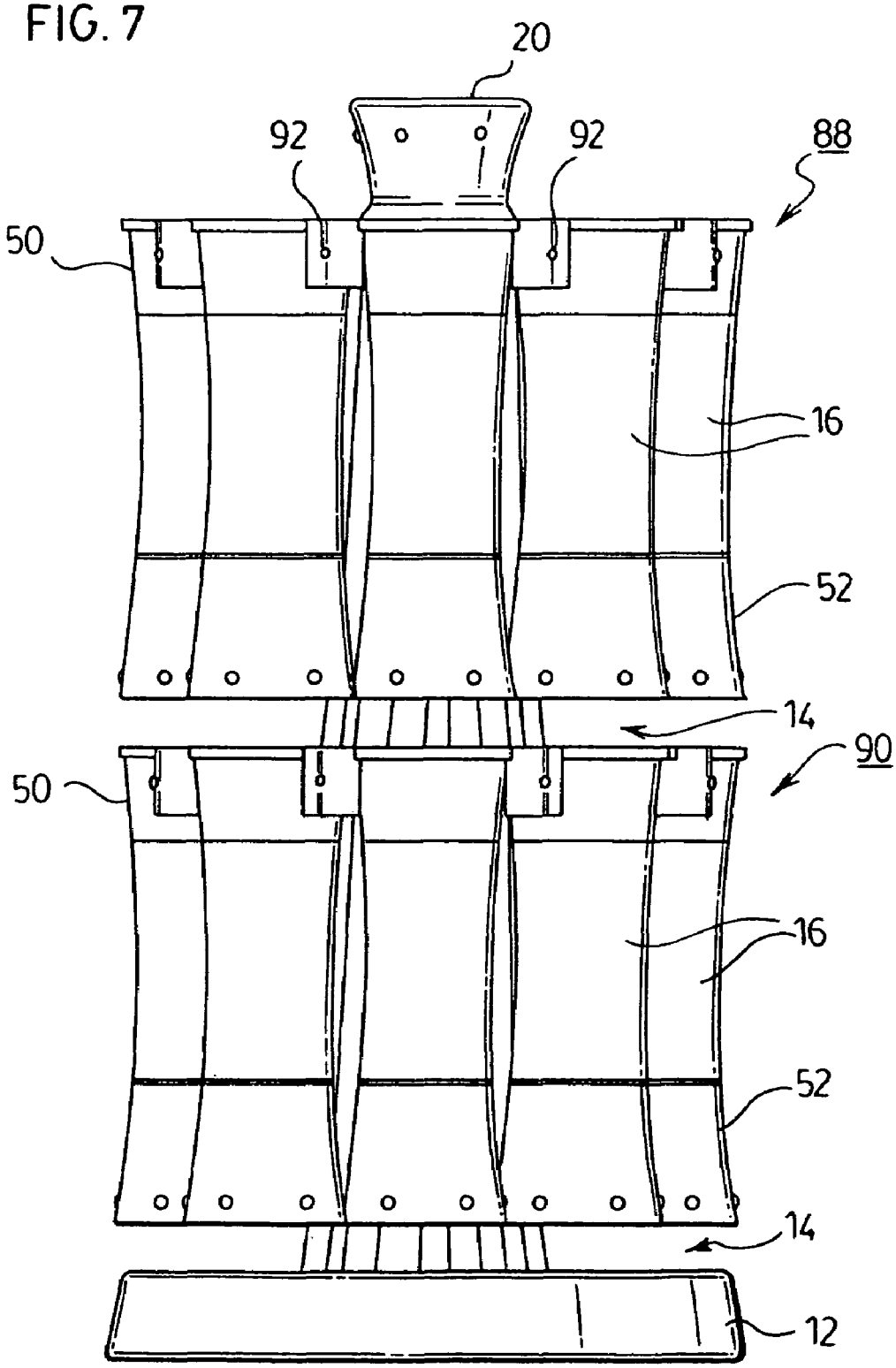
FIG. 7 is a front elevation view of a pair of carousels of the type shown in FIG. 1 stacked and attached together.

Referring now to FIGS. 1 and 4, each of the dispensing containers 16 is of a generally cylindrical shape, with a upper portion 50, a lower portion 52, a transparent side wall portion 48 (FIG. 4), and a cap 54 at the top of the upper portion 50.

As it is shown in FIG. 4, the cap 54 is attached to a slider structure 56 with a dispensing outlet opening 60 when the cap 54 is pulled upwardly as shown in FIG. 4.

When the slider structure is retracted, the opening 60 is closed and the cap 54 covers the entire upper surface of the container.

The dispensing container construction is shown in greater detail in the cross-sectional views of FIGS. 5 and 6.

As it is shown in FIG. 5, the upper portion of the body of the container is inset as shown at 64. A tapered outer ring 50 is fastened to screw threads 68 (see FIG. 6) to fasten it in place. The diameter of the ring 50 is larger than the diameter of the outer wall 66 of the upper inset portion of the container, so as to form an annular space between the inner surface of the ring 50 and the outer surface of the wall 66.

Into that space is fitted the slider structure 56. The slider structure has an outwardly-extending ridge 70 at its bottom edge which bears against the inner surface of the outer ring 50, and the upper inner edge of the ring 50 has an inwardly-extending flange 72 against which the slider 56 also bears. The container and the carousel preferably are molded of plastic materials with some flexibility.

Thus, when the slider 56 is pulled upwardly, with moderate force, the ridge 70 engages the flange 72 and acts as a detent to hold the cap and the slider in the extended position without allowing the slider to be removed completely from the container body.

Screw threads (not shown) are provided to allow the removal of the cap and the slider from the top of the container completely. This allows ready access to the inside of the container for refilling it, for dipping out contents with a spoon inserted through the large opening thus formed, or for pouring out large quantities of materials.

The structure shown also has the advantage that it minimizes the possibility of condiments entering into the area where the slider slides, and thus avoids interference with the operation due to accumulated matter in the sliding mechanism.

The outer edge 62 of the cap 54 extends beyond the outwardly tapered ring 50. This provides a ridge which fits into the groove 29 in the holding structure 18 (see FIG. 2) to hold the containers in position on the holding structure.

The container-receiving recesses shown in FIG. 2 are made slightly more than half-circles to improve the holding of the containers.

Again referring to FIG. 5, the dispensing mechanism is indicated at 74. The dispensing structure includes a plurality of vertical panels 86 which form separate radial compartments 78 around a central axis 79. A structure 76 with a post 84 is secured in a recess in the lower portion of the housing body. A gate plate 81 is secured by a screw and washer 82 to the post 84. Plate 81 covers the bottoms of the compartments 78 but has a single hole 80 the size of one compartment. The panels 86 are secured to the ring 52. Rotation of the ring 52 moves the compartments 78 sequentially past the outlet opening 80 to dispense the pre-measured contents of the compartments, and past a hole 81 in the upper wall of the structure 76 to re-fill the compartments. The openings 80 and 81 are spaced from one another circumferentially.

The rings 50 and 52 are faired with the remainder of the housing to give it a smooth appearance.

The dispensing mechanism 74 is otherwise well known and will not be further described here. However, it operates to dispense, with each increment of rotation, the contents of one of the compartments 78 so as to deliver a pre-measured quantity of condiment through the bottom opening of the dispensing container.

The container can be used to dispense pre-measured quantities using the dispensing mechanism at the bottom, or the retractable spout can be used to pour the condiments from the container. If desired, other dispensing openings can be used. For example, slits or multiple small holes can be provided in a portion of the slider 56 of the container 16 opposite the opening 60 so as to give the user the option of a shaker outlet or a pouring outlet.

Thus, the foregoing objects have been satisfied by the provision of the invention as described above.

The above description of the invention is intended to be illustrative and not limiting. Various changes or modifications in the embodiments described may occur to those skilled in the art. These can be made without departing from the spirit or scope of the invention.

What is claimed is:

1. A condiment dispenser carousel, said carousel comprising, a base structure, said base structure including a base member and a central projection having a lower end and an upper end extending upwardly from said base member, a condiment dispenser holding structure mounted adjacent said upper end of said projection to rotate relative to said base member and said projection, said holding structure including a plurality of holders shaped to hold condiment dispensers of a corresponding shape, said projection being releasably secured to said base member with a manually-releasable locking structure, said locking structure including a first locking element on said base member and a mating second locking element on said central projection, said first and second locking elements being shaped to lock together and unlock from one another in response to manual movement of said projection and said base member relative to one another, said holding structure having at its top another locking element like said first locking element adapted to receive and lock to a second locking element on the central projection of another carousel whereby two of said carousels can be mounted atop one another and locked together.

2. A carousel as in claim 1 in which said central projection includes a bottom ring and a top ring, and a plurality of vertical struts having two ends and extending between and secured at each of its ends to one of said rings.

3. A carousel as in claim 2 in which said first locking element comprises a lock tab structure formed in said lower ring and said second locking element comprises a lock tab receptacle for rotatably locking said ring and said base member together.

4. A carousel as in claim 1 in which said holding structure comprises a hub, and a plurality of arms extending radially outwardly from said hub and dimensioned to receive a plurality of condiment dispensing containers and to fit under an edge of said containers to support said containers.

5. A carousel as in claim 2 including a plurality of condiment dispensing containers held by said holders, each of said containers being substantially cylindrical and having an engagement structure near its top for engaging with one of said holders.

6. A carousel as in claim 1 including a plurality of condiment dispensing containers held by said holders, each of said containers including a retractable pop-up spout at the top for pouring granular solid condiments out of said container.

7. A carousel as in claim 1 including a plurality of condiment dispensing containers held by said holders, each of said containers having a rotary pre-measured quantity dispensing mechanism rotatable by twisting the lower portion of the housing of said container, and an upper rim capable of use in supporting said container.

8. A carousel as in claim 1 in which said hub structure includes a hub member secured to said projection and having a bearing structure for rotatably supporting said holding structure at a location above said base member, said holding structure having a hub rotatably mounted on said bearing structure and support arms extending from said hub.

9. A method for mounting two condiment container carousels atop one another for rotary operation together, said method comprising (a) providing a first carousel with a base, a first central projection removably secured to said base, a condiment container holder rotatably mounted on said projection, and an upper locking structure on said holder for receiving a mating locking structure on the lower end of one of said projections, (b) providing another one of said central projection with one of said condiment container holders rotatably mounted thereon, (c) manually engaging the lower end of said other projection with said upper locking structure to lock said other projection to said container holder, and in which each of said first and second central projections has a first rotary lock tab structure at its lower end, and each of said base and said container holder has a corresponding lock tab structure engageable with said first lock tab structure, and said manual engaging step comprising thrusting said first rotary lock tab structure against said corresponding lock tab structure and rotating said other central projection relative to said holder.

* * * * *